United States Patent [19]

Burke

[11] Patent Number: 4,993,207

[45] Date of Patent: Feb. 19, 1991

[54] ROOF SHINGLE LAYING MACHINE

[76] Inventor: Jerome F. Burke, 28635 N. Jackson, Wauconda, Ill. 60084

[21] Appl. No.: 390,235

[22] Filed: Aug. 7, 1989

[51] Int. Cl.[5] ..... E04D 15/02

[52] U.S. Cl. ..... 52/749; 221/185; 221/232

[58] Field of Search ..... 52/749; 221/185, 232

[56] References Cited

U.S. PATENT DOCUMENTS 4,656,808 4/1987 Mansfield ..... 221/240 X 4,700,526 10/1987 McGuinness ..... 52/749

*Primary Examiner*—Richard E. Chilcot, Jr.

*Attorney, Agent, or Firm*—Beverly A. Vandenburgh

[57] ABSTRACT

A shingle laying device for placing and attaching shingles on a roof surface has a frame, a storage compartment for holding a plurality of shingles to be laid, and a placement compartment for holding a single shingle at a desired position on the roof surface. A transfer mechanism is employed to transfer a single shingle from the storage compartment to the placement compartment, and an attachment mechanism is employed to attach the single shingle held by the placement compartment to the roof surface.

20 Claims, 2 Drawing Sheets

ROOF SHINGLE LAYING MACHINE

BACKGROUND OF THE INVENTION

This invention relates to a roof shingle laying machine which automatically places a shingle in a desired position on a roof of a building, and then staples the shingle to the roof.

When laying shingles on the roof of a building, it is of course very important to align the shingles properly relative to the roof and relative to the other shingles. Most commercially-available asphalt roof shingles are provided with slots on the top and side surfaces which allow the shingles to be placed properly by hand, and then secured. However, such manual placement and securing of the shingles is time consuming, and requires continuous strenuous contortions of the roofer. Therefore, various shingle laying devices have been developed for automatically placing a shingle on a roof and then securing the shingle to the roof.

One such device is disclosed in U.S. Pat. No. 4,656,808 to Mansfield. According to this reference, the roof shingles are placed by the operator on a large rotating drum. As the device is pushed along the roof, the drum rotates, causing a shingle to be deposited on the roof surface. The drum is indexed so that the shingle is deposited when the device has been moved the correct distance. Attached to the device are staplers which then staple the shingle to the roof.

However, this device suffers from various drawbacks. One, the shingles must manually be moved by the operator onto the rotating drum. Two, because the shingles are rotated with the drum, it is difficult to keep the shingles properly aligned with the drum while the device is moved. Also, this device is certainly very complicated and cumbersome to operate. Finally, the inherent characteristics of shingles do not allow them to be bent to conform to the curve of the drum--bending will cause cracking and/or delamination of the fibers in shingles.

SUMMARY OF THE INVENTION

A primary object of the present invention is to provide a machine for automatically placing shingles in the proper position on the roof of a building and then securing the shingles to the roof.

It is a further object of the present invention to be able to lay the shingles quickly, and to minimize the effort required by the operator using the machine.

It is a further object of the present invention to provide such a machine which can be used on a wide variety of sloped, as well as flat, roofs.

These and other objects are achieved by a shingle-laying device having a frame, a storage compartment attached to the frame for holding a plurality of shingles to be laid and a placement compartment attached to the frame for holding a single shingle at a desired position on the roof surface. A transfer mechanism is employed to transfer a single shingle from the storage compartment to the placement compartment, and an attachment mechanism is employed to attach the single shingle held by the placement compartment to the roof surface.

The shingles located in the storage compartment are preferably biased up and out of the compartment, and the transfer mechanism is preferably a wedge which is attached to the frame and which can move transverse to opening in the storage compartment so as to push the upper shingle to the placement compartment. The attaching mechanism can be a plurality of staple or nail guns attached to a rod and located above the placement compartment. The rod can be moved vertically so as to position the staple or nail guns down on top of the shingle deposited in the placement compartment, and then staple the shingle to the roof.

The device is provided on wheels so that it can be rolled across the roof surface. The angle of attachment of the wheels to the frame is preferably variable, maintaining a vertical position to the ground so that the device can conform to roofs of differing slopes.

In order to accurately determine how far the device should be pushed forward when laying successive shingles, a tracing wheel having a circumference equal to the length of the shingles is attached to the frame. Thus, after one shingle is laid, the device is merely pushed forward for one full revolution of the tracing wheel, and then the next shingle can be laid. A larger tracing wheel can be used to accommodate the large sizes of metric shingles. Rubber stops are preferably attached to the front of the placement compartment, so that if the device is pushed too far forward, the shingle in the placement compartment can be pulled back by pulling the machine back.

BRIEF DESCRIPTION OF THE DRAWINGS

These and other features of the invention will be described in connection with the detailed description and accompanying drawings, in which.

DETAILED DESCRIPTION OF THE INVENTION

As seen in the Figures, the shingle-laying device, designated generally at 1, is shown resting on a roof surface 3. The device includes a frame 4, a storage compartment 5 for holding a plurality of shingles, and a placement compartment 7 for holding a single shingle to be attached to the roof. It is noted that shingles are generally manufactured of a standard size (36" by 12"), and the compartments are made to have an opening slightly larger than the size of the shingles. The walls of the compartments can be adjustable to accommodate larger metric sizes.

Figure 1:
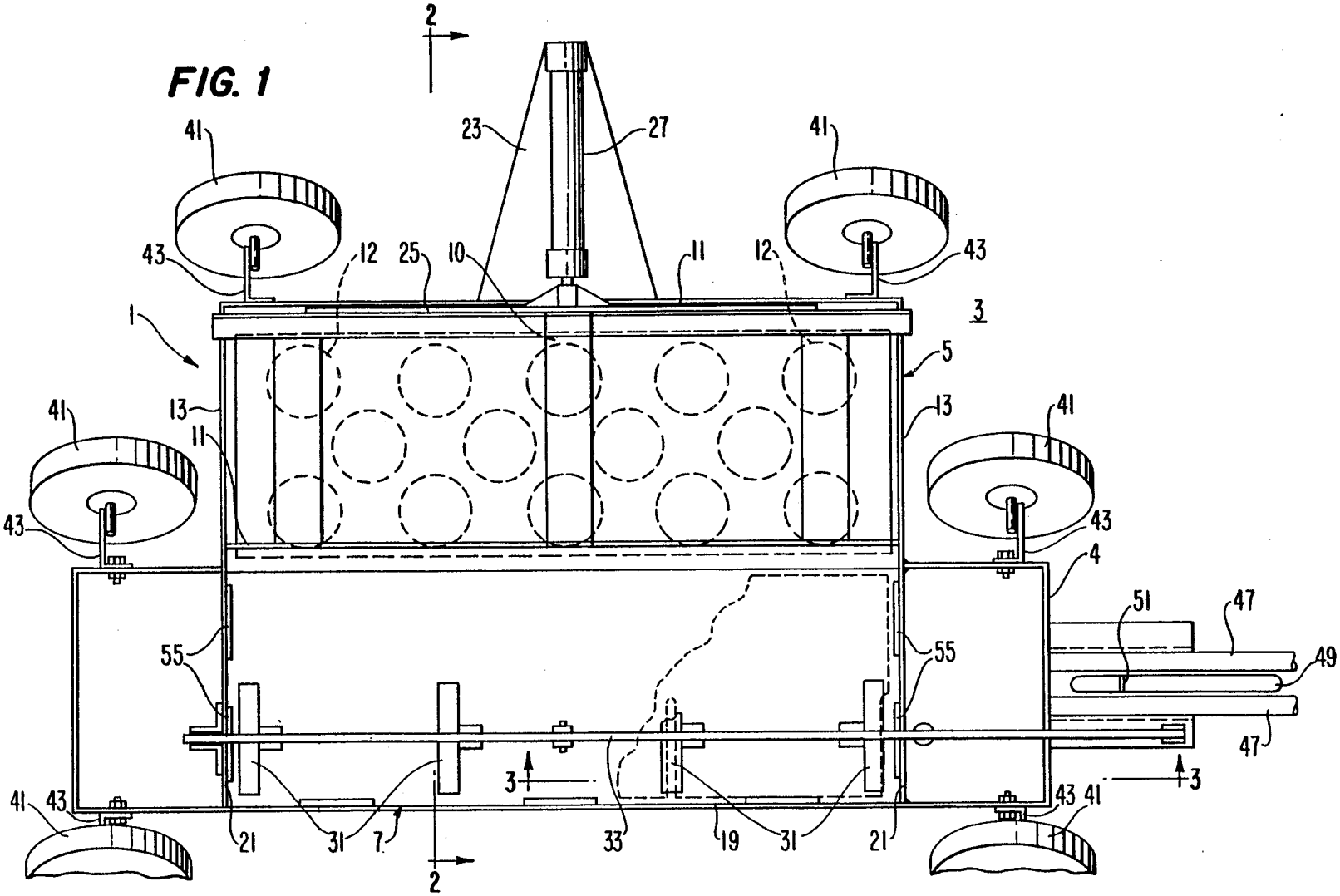
FIG. 1 is top view of the front-portion of the device of the invention, shown on a roof surface.
Figure 2:
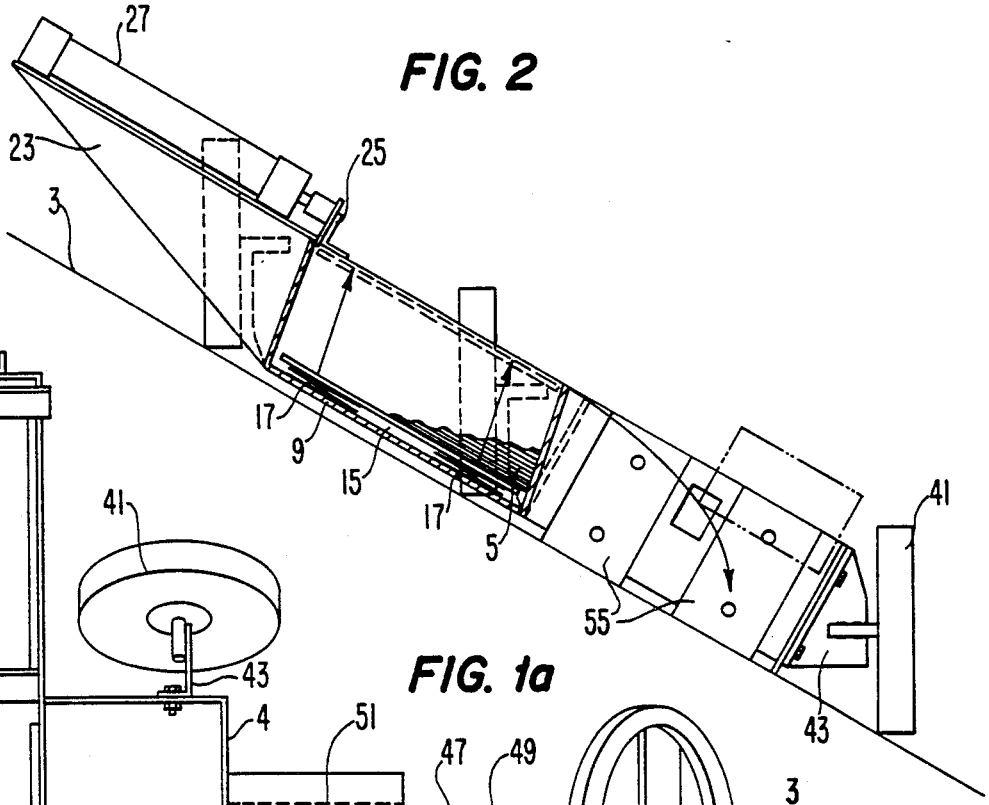
FIG. 2 is a cross-section taken along lines 2—2 in FIG. 1.
Figure 1A:
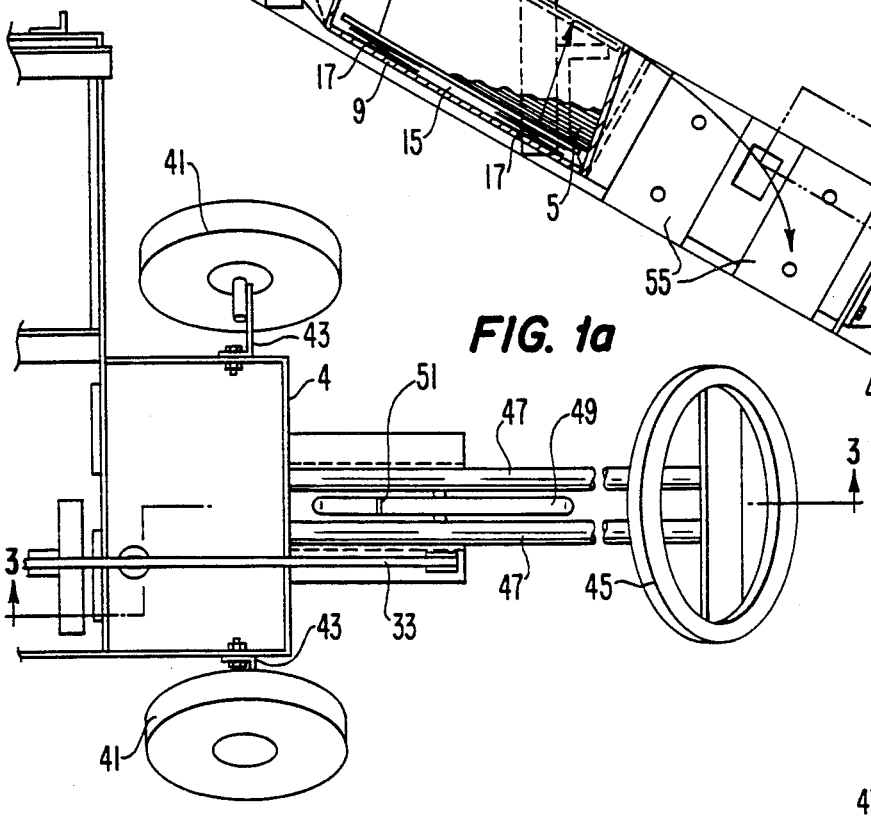
FIG. 1*a* is a top view of the front portion of the device shown in FIG. 1.

The storage compartment 5 has a bottom wall 9, two opposing side walls 11, and two opposing end walls 13. As seen in FIG. 2, the side walls 11 are preferably not formed at a right angle relative to the bottom wall 9, but instead are angled slightly, so that the angle between the bottom wall and the side walls is, for example, 80 degrees. The reason that this is done is that shingles are often slightly stuck together in the manufacturing and packaging processes. By angling the side walls, the shingles S stored within the storage compartment will be forced to move laterally with respect to each other, thus separating the stuck shingles.

Within the storage compartment 5, a platform 15 is movably provided. A biasing means such as springs 17 (FIG. 2) placed between the platform and the bottom wall 9 presses the platform 15 up towards the top of the storage compartment. The shingles S are placed on the platform, so that the shingles are biased toward the top of the storage compartment. Hinged guiding rail 10 and hinged positioning rails 12 keep the shingles from being pressed out of the compartment.

The placement compartment 7 is open at the bottom and is defined by one of the side walls 11, as well as an additional side wall 19 and two opposing end walls 21.

An extension platform 23 is attached to the frame and extends from the storage compartment 5. In order to move the shingles from the storage compartment to the placement compartment, a transfer means consisting of a wedge 25 is attached to an electrically-actuated solenoid 27. As seen in FIG. 2, the wedge 25 is generally L-shaped. The wedge engages the edge of the uppermost shingle in the storage compartment so that when the solenoid causes the wedge to move toward the placement compartment, the uppermost shingle is pushed sideways until it falls into the placement compartment 7.

Figure 3:
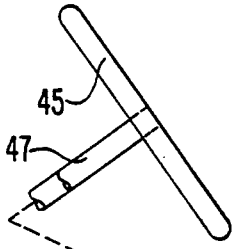
FIG. 3 is a cross-section taken along lines 3—3 in FIG. 1.
Figure 3:
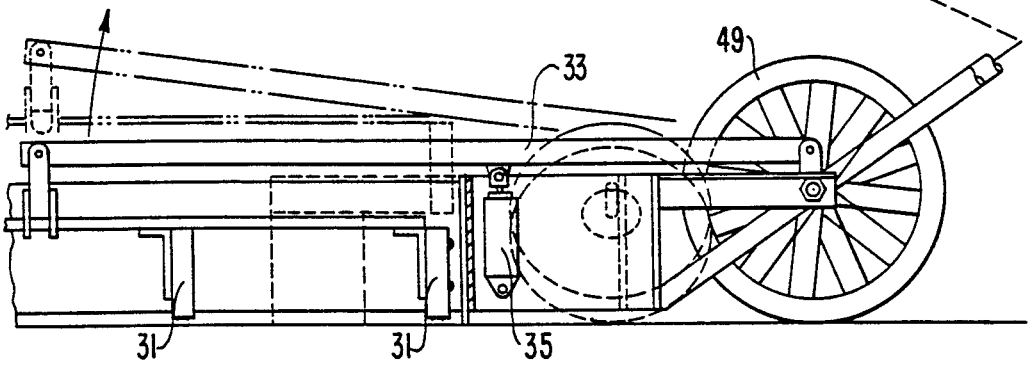

An attachment mechanism is provided to attach the shingle which is transferred to the placement compartment to the roof surface. According to the preferred embodiment, this attachment mechanism consists of a plurality (four are illustrated in the FIGS.) of staple or nail guns 31 attached to a rod 33. One end of the rod is pivotally connected to the forward end of the frame at 34 (see FIG. 3), while a mid-portion of the rod 33 is connected to electrically-actuated solenoid 35. Thus, by actuating the solenoid, the rod can be made to pivot so as to raise and lower the staple guns 31. The staple guns are raised when a shingle is transferred to the placement compartment, and then are lowered so that the staple guns rest on the shingle.

The shingle guns are preferably of the electric type which can subsequentlY be actuated by an actuating device (not shown). Both of the solenoids 27 and 35, as well as the staple guns 31, are powered by a single battery (not shown), and are electrically connected to actuating switches (also not shown) so that the solenoids and staple guns can be operated at the appropriate times. It is also possible to use regular 110 volt a.c. current to power the electrically-operated elements.

A plurality of wheels 41 (six are used in the preferred embodiment) are provided to enable the shingle laying machine to be pushed across the roof surface. For stability of the machine, it is desirable that the wheels remain generally vertical (to the ground), while the frame and compartments must extend generally parallel to the roof surface. Therefore, the wheels 41 are pivotably connected to brackets 43 attached to the frame, so that the machine can conform to the angle of inclination of the roof surface. Preferably, the pivotable wheels allow the machine to be used on roofs having an angle of inclination which varies from 0 degrees to 33⅓ degrees.

At the rear end of the machine, a handle 45 is connected to the frame via bars 47. The operator of the machine can push the machine across the roof using the handle 45. A tracing wheel 49 is provided between the bars 47. The bottom of the tracing wheel contacts the roof surface so that the tracing wheel rotates as the machine is pushed. Tracing wheel 49 is designed so as to have a circumference which is equal to the length (generally 36") of a shingle. A mark 51 is provided on the tracing wheel, so that the operator can tell that when the tracing wheel has rotated one full revolution, the machine is in position to lay the next shingle.

Note that preferably a small space exists between the end walls 21 of the placement compartment and the roof surface so that the shingles do not interfere with the movement of the machine after they are attached to the roof. However, four stops 55, preferably made of rubber, are provided at the bottom of the front and rear end walls 21 and extend flush to the roof surface. Therefore, if the machine is pushed too far forward or backward, the shingle in the placement compartment can be dragged back by the rubber stops.

The device operates as follows. First, a plurality of shingles are placed in the storage compartment 5. The machine is placed at one edge of the roof in the proper position for laying the first shingle. Solenoid 27 is then actuated, causing wedge 25 to push the top shingle laterally into the placement compartment 7. The rod 33 is then moved downward by solenoid 35 so that the staple guns 31 press against the shingle in the placement compartment. The staple guns are actuated so that staples attach the shingle to the roof surface. The operator then pushes the machine forward so that the tracing wheel turns one full revolution. At this point the machine is in proper position for the second shingle, so the transfer and attachment procedures are repeated. The machine is thus pushed across the roof surface to the other edge of the roof, at which time the machine is turned around, and the process starts again.

Many modifications of the above-described preferred embodiment are possible without departing from the spirit and scope of the invention. For example, the actuators need not be electric solenoids, but can be any suitable type of actuator. A different type of biasing means than the springs which are shown can be used. The size and proportions of the various elements can be varied. Therefore, the scope of the invention should not be judged from the preferred embodiment, but from the following claims.

I claim:

1. A device for automatically laying and securing shingles to a roof surface, comprising:

a frame;

a storage compartment attached to said frame for holding a plurality of shingles to e laid;

a placement compartment attached to said frame for holding a single shingle at a desired position on the roof surface, said placement compartment being located laterally adjacent to said storage compartment;

transfer means for transferring a single shingle from said storage compartment to said placement compartment; and attachment means for attaching the single shingle held by said placement compartment to said roof surface.

2. The device as claimed in claim 1, further comprising a plurality of wheels attached to said frame, wherein said wheels are adjustable relative to said frame so as to conform to a sloped roof surface whereby the wheels are maintained perpendicular to the ground.

3. The device as claimed in claim 1, wherein said storage compartment has a base and four side walls, and further comprising a platform located within said storage compartment on which said plurality of shingles rest, and means for biasing said platform away from the base of said storage compartment.

4. The device as claimed in claim 3, wherein two of said four side walls are angled at an angle other than 90 degrees relative to said base.

5. The device as claimed in claim 4, wherein said angle is approximately 80 degrees.

6. The device as claimed in claim 1, wherein said transfer means comprises at least one wedge attached to said frame for engaging a single shingle located in the storage compartment, and means for moving said wedge relative to said storage compartment so as to push said single shingle located in the storage compartment to the placement compartment.

7. The device as claimed in claim 6, wherein said moving means comprises an electrically-actuated solenoid.

8. The device as claimed in claim 1, wherein said attachment means comprises a rod attached to the frame, a plurality of staple or nail guns attached to the rod, and means for moving said rod so as to cause said staple or nail guns to press against the single shingle held by said placement compartment.

9. The device as claimed in claim 8, wherein said moving means comprises an electrically-actuated solenoid.

10. The device as claimed in claim 1, further comprising a handle attached to said frame for manually pushing said device across said roof surface.

11. The device as claimed in claim 1, further comprising measuring means for measuring a predetermined distance to move said device across said roof surface when laying consecutive shingles.

12. The device as claimed in claim 11, wherein said measuring means comprises a tracing wheel having a circumference approximately equal to a length of said shingles.

13. The device as claimed in claim 1, further comprising a plurality of rubber stops attached to a front and a rear edge of said placement compartment, wherein said rubber stops can engage the single shingle held by said placement compartment.

14. The device as claimed in claim 6, wherein said wedge engages an edge of said single shingle located in the storage compartment.

15. A device for automatically laying and securing shingles to a roof surface, comprising:

a frame;

a storage compartment attached to said frame for holding a plurality of shingles to be laid;

a placement compartment attached to said frame for holding a single shingle at a desired position on the roof surface;

transfer means for transferring a single shingle from said storage compartment to said placement compartment;

attachment means for attaching the single shingle held by said placement compartment to said roof surface; and a plurality of wheels attached to said frame, wherein said wheels are adjustable relative to said frame so as to conform to a sloped roof surface whereby the wheels are maintained perpendicular to the ground.

16. A device for automatically laying and securing shingles to a roof surface, comprising:

a frame;

a storage compartment attached to said frame for holding a plurality of shingles to be laid, said storage compartment having a base and four side walls;

a placement compartment attached to said frame for holding a single shingle at a desired position on the roof surface;

transfer means for transferring a single shingle from said storage compartment to said placement compartment;

attachment means for attaching the single shingle held by said placement compartment to said roof surface;

a platform located within said storage compartment on which said plurality of shingles rest; and means for biasing said platform away from the base of said storage compartment.

17. The device as claimed in claim 16, wherein two of said four side walls are angled at an angle other than 90 degrees relative to the base.

18. The device as claimed in claim 17, wherein said angle is approximately 80 degrees.

19. A device for automatically laying and securing shingles to a roof surface, comprising:

a frame;

a storage compartment attached to said frame for holding a plurality of shingles to be laid;

a placement compartment attached to said frame for holding a single shingle at a desired position on the roof surface;

transfer means for transferring a single shingle from said storage compartment to said placement compartment;

attachment means for attaching the single shingle held by said placement compartment to said roof surface; and measuring means for measuring a predetermined distance to move said device across said roof surface when laying consecutive shingles, comprising a tracing wheel having a circumference approximately equal to a length of said shingles.

20. A device for automatically laying and securing shingles to a roof surface, comprising:

a frame;

a storage compartment attached to said frame for holding a plurality of shingles to be laid;

a placement compartment attached to said frame for holding a single shingle at a desired position on the roof surface;

transfer means for transferring a single shingle from said storage compartment to said placement compartment;

attachment means for attaching the single shingle held by said placement compartment to said roof surface; and a plurality of rubber stops attached to a front and rear edge of said placement compartment, wherein said rubber stops can engage the single shingle held by said placement compartment.

* * * * *